US009148977B1

(12) United States Patent
Williams

(10) Patent No.: US 9,148,977 B1
(45) Date of Patent: Sep. 29, 2015

(54) AUDIO-VIDEO EQUIPMENT STAND

(71) Applicant: Frederick Williams, London (GB)

(72) Inventor: Frederick Williams, London (GB)

( * ) Notice: Subject to any disclaimer, the term of this patent is extended or adjusted under 35 U.S.C. 154(b) by 25 days.

(21) Appl. No.: 13/986,791

(22) Filed: Jun. 5, 2013

(51) Int. Cl.

| | |
|---|---|
| ***A47F 5/00*** | (2006.01) |
| ***A47F 7/00*** | (2006.01) |
| ***H05K 7/18*** | (2006.01) |
| ***A47B 47/00*** | (2006.01) |
| ***A47B 47/02*** | (2006.01) |
| *A47B 21/06* | (2006.01) |
| *A47B 83/00* | (2006.01) |
| *A47B 96/14* | (2006.01) |

(52) U.S. Cl.

CPC ..... *H05K 7/18* (2013.01); *A47B 47/0083* (2013.01); *A47B 47/021* (2013.01); *A47B 2021/064* (2013.01); *A47B 2021/066* (2013.01); *A47B 2021/068* (2013.01); *A47B 2083/003* (2013.01); *A47B 2096/1491* (2013.01); *A47B 2200/0081* (2013.01); *A47B 2200/0082* (2013.01); *A47B 2200/0083* (2013.01)

(58) Field of Classification Search

CPC ..... H01K 7/18; H01K 7/20536; A47B 2220/003; A47B 2220/0038; A47B 2220/0091; A47B 2200/008; A47B 2200/0081; A47B 2200/0082; A47B 2200/0083; A47B 2097/003; A47B 2096/1491; A47B 96/14; A47B 96/1443; A47B 96/1441; A47B 96/00; A47B 96/02; A47B 91/02; A47B 91/022; A47B 91/024; A47B 91/026; A47B 2083/003; A47B 57/06; A47B 57/30; A47B 47/02; A47B 47/021; A47B 47/024; A47B 47/027; A47B 47/045; A47B 47/0083; A47B 2031/004; A47B 2021/064; A47B 2021/066; A47B 2021/068

USPC ..... 211/190, 186, 26, 134; 312/223.1, 312/223.6, 140, 265.1–265.4; 108/180, 108/193, 186; 361/724

See application file for complete search history.

(56) References Cited

U.S. PATENT DOCUMENTS

| | | | | | |
|---|---|---|---|---|---|
| 3,606,020 | A | * | 9/1971 | Kern | 211/26 |
| 4,094,256 | A | * | 6/1978 | Holper et al. | 108/50.02 |
| 4,338,866 | A | * | 7/1982 | Streit | 108/191 |
| 4,579,233 | A | * | 4/1986 | Hepp | 211/126.12 |
| 4,593,825 | A | * | 6/1986 | Hepp | 211/126.12 |
| 5,024,167 | A | * | 6/1991 | Hayward | 108/50.02 |
| 5,044,135 | A | * | 9/1991 | Kroon et al. | 52/239 |
| 5,083,512 | A | * | 1/1992 | Newhouse et al. | 108/50.02 |
| 5,435,254 | A | * | 7/1995 | Amey et al. | 108/64 |

(Continued)

*Primary Examiner* — Jennifer E Novosad

(74) *Attorney, Agent, or Firm* — Patents on Demand P.A.; Brian K. Buchheit; Scott M. Garrett

(57) ABSTRACT

Audio-Video Equipment Stand, suitable for supporting audio and video equipment constructed from a metal alloy type material, is dominated by four vertical support columns which provide support to the audio-video equipment stand shelves, are characterized by their size material make up and the unique support device bound to the audio-video equipment stand shelves, are visually well proportioned reflecting their ability to accommodate a wide variety of audio and video equipment, with the addition of sub frame and support bracket configurations, enable the housing of the audio-video equipment stand shelves, in addition, the audio-video equipment stand has the provision for engaging the connectivity requirements of audio and video equipment, courtesy of the connection options integrated into the audio-video equipment stand, thus enabling all forms of supported audio and video equipment to receive power, ensuring correct operation of all audio and video equipment.

28 Claims, 18 Drawing Sheets

(56) References Cited

U.S. PATENT DOCUMENTS

| | | | | |
|---|---|---|---|---|
| 5,673,632 | A * | 10/1997 | Sykes | 108/121 |
| 6,113,198 | A * | 9/2000 | Hommes | 312/114 |
| 6,135,583 | A * | 10/2000 | Simon et al. | 312/257.1 |
| 6,199,705 | B1 * | 3/2001 | Portner | 211/26 |
| 6,283,043 | B1 * | 9/2001 | Stern et al. | 108/50.02 |
| 6,311,856 | B2 * | 11/2001 | Battaglia et al. | 211/187 |
| 6,407,332 | B1 * | 6/2002 | Buchberger et al. | 174/50 |
| 7,090,315 | B1 * | 8/2006 | Horne | 312/265.4 |
| 7,626,120 | B1 * | 12/2009 | Golden et al. | 174/53 |
| 8,196,526 | B2 * | 6/2012 | Rheault et al. | 108/50.01 |
| 2004/0036389 | A1 * | 2/2004 | Tsai | 312/265.4 |
| 2004/0124751 | A1 * | 7/2004 | Arent et al. | 312/249.9 |
| 2007/0163980 | A1 * | 7/2007 | Gonzalez Llorens | 211/189 |
| 2013/0055604 | A1 * | 3/2013 | Herman Baran et al. | 40/606.03 |
| 2013/0193098 | A1 * | 8/2013 | Fanourgiakis et al. | 211/134 |
| 2014/0331901 | A1 * | 11/2014 | Seefeldt et al. | 108/50.02 |

* cited by examiner

AUDIO-VIDEO EQUIPMENT STAND

CROSS-REFERENCE TO RELATED APPLICATIONS

None

STATEMENT REGARDING FEDERALLY SPONSORED RESEARCH OR DEVELOPMENT

None

THE NAMES OF THE PARTIES TO A JOINT RESEARCH AGREEMENT

None

INCORPORATION-BY-REFERENCE OF MATERIAL SUBMITTED ON A COMPACT DISC

None

REFERENCE TO A MICROFICHE APPENDIX

None

BACKGROUND OF THE INVENTION

A wide range of audio and video equipment require some form of supporting apparatus which provides audio and video equipment with a stable platform, thereby ensuring a functional and operational environment is maintained, conducive to the operational requirements of audio and video equipment. The various support apparatus can be in the form of wall mounted shelves, free standing racks, free standing cabinets or freely independent stands with shelving arrangements. Typically most support apparatus share a common purpose, thereby maintaining a standard set of limited features which are exemplified in their construction, usually welded in nature, a standard shelving arrangement with dimensions and fitments that may limit the type of audio and video equipment that can be accommodated by the support apparatus plus the cumbersome exercise of cable management. The stylisation of some support apparatus has improved over the years but many still exhibit a very one dimensional cosmetic makeup and functionality, which invariably is disproportionate to the cost of such apparatus.

This invention, referred to as the audio-video equipment stand, has embraced some of these limited features, thereby creating a concept which addresses some of the short comings of previous and present support apparatus, thereby providing a support apparatus which is able to function in both domestic and professional environments. The concept revolves around the immediate availability of power courtesy of the socket outlet componentry integrated within the audio-video equipment stand.

In order to liberate audio and video equipment from the reliance on lengthy power cables and additional ancillaries, a central hub needs to be established in order to provide equal and immediate access to power for all audio and video equipment. Therefore, the audio-video equipment stand becomes the focal point for any professional or domestic audio and video installation, providing a support platform and connectivity options made available by the audio-video equipment stand.

FIELD OF THE INVENTION

The present invention relates to the audio-video equipment stand that will find use in supporting all forms of audio and video equipment. This invention has been conceived as an improvement by way of providing connectivity options integrated within the audio-video equipment stand, enabling all audio and video equipment to be connected directly to the audio-video equipment stand, thereby reducing the dependency on acquiring additional equipment for the purpose of providing connection options in order to accommodate the connectivity requirements of all types of audio and video equipment.

It is common practice for many manufactures to equip audio and video equipment with a power cable measuring in excess of one meter. This practice invariably addresses the inconvenience users are presented with when seeking access to inconveniently located socket outlets. The audio-video equipment stand on the other hand is fully garnished with an array of socket outlets, referred to as receptacles which when utilised, provide an alternative to and the reliance on lengthy cable runs thereby drastically reducing the dependence on and need to source other ancillaries. Addressing these concerns, the audio-video equipment stand has created a power and cable management system which in the long term caters to an audience of users who seek to exploit the advantages of such a concept, whilst paying attention to issues such as carbon foot printing. The reduction in the use of conductive materials found in a variety of power cables not only addresses such issues, but helps in the reduction of it's total cost of ownership, in addition to the enhanced performance to be had using a shorter cable run.

The alloy construction of the audio-video equipment stand forms the main structural make up of this invention. Unlike other stands, the audio-video equipment stand features a number of modular characteristics, enabling the interchange ability of a number of key components or a combination of these components, allowing an upgrade path to be pursued. The upgrade path will provide users with options such as interchangeable shelves, different in size and material types plus different support devices, all of which utilise existing housing and fixing arrangements. With the connection options in place, the audio-video equipment stand is more than capable of providing a similar service to devices which are not dependent on the support platform of the audio-video equipment stand, example being equipment used for household domestic purposes, can utilise the connectivity options made available courtesy of the audio-video equipment stand.

This invention is a floor standing, rigid, audio and video equipment stand, which showcases a number of unique features, one of which being the conical point-to-point support device, plus a removable, adjustable, bracketing system which permits the reconfiguration of the audio-video equipment stand shelving arrangement to include the addition of an extra shelf. The upgrade path, which takes into account these unique features, ensures that the future proofing character of the audio-video equipment stand is in keeping with the concept of this invention.

BRIEF SUMMERY OF THE INVENTION

The audio-video equipment stand, which is floor standing in nature, provides a support platform for audio and video equipment with the added benefit of socket outlets, referred to as receptacles, are integrated into the audio-video equipment stand. The audio-video equipment stand permits all forms of audio and video equipment, be they analogue or digital in nature to be supported by the audio-video equipment stand, thereby enabling all forms of audio and video equipment to utilise the connectivity options exhibited in the form of receptacles. It's structural characterisation is dependent on four vertical support columns, consisting of two front and two rear vertical support columns, a sub frame arrangement located at the top and bottom of the audio-video equipment stand, which serves a dual purpose, by providing a rigid stable framework to the vertical support columns and a support platform for the top most and bottom most audio-video equipment stand shelves. Support brackets specific to the audio-video equipment stand are introduced thereby providing support to the remaining audio-video equipment stand shelves. At the base of the audio-video equipment stand is the cable manifold that houses the ac receptacle inlet responsible for receiving power from an appropriate energy source thereby ensuring all respective receptacles housed by the audio-video equipment stand are rendered operational.

DETAILED DESCRIPTION OF THE INVENTION

Figure 1:
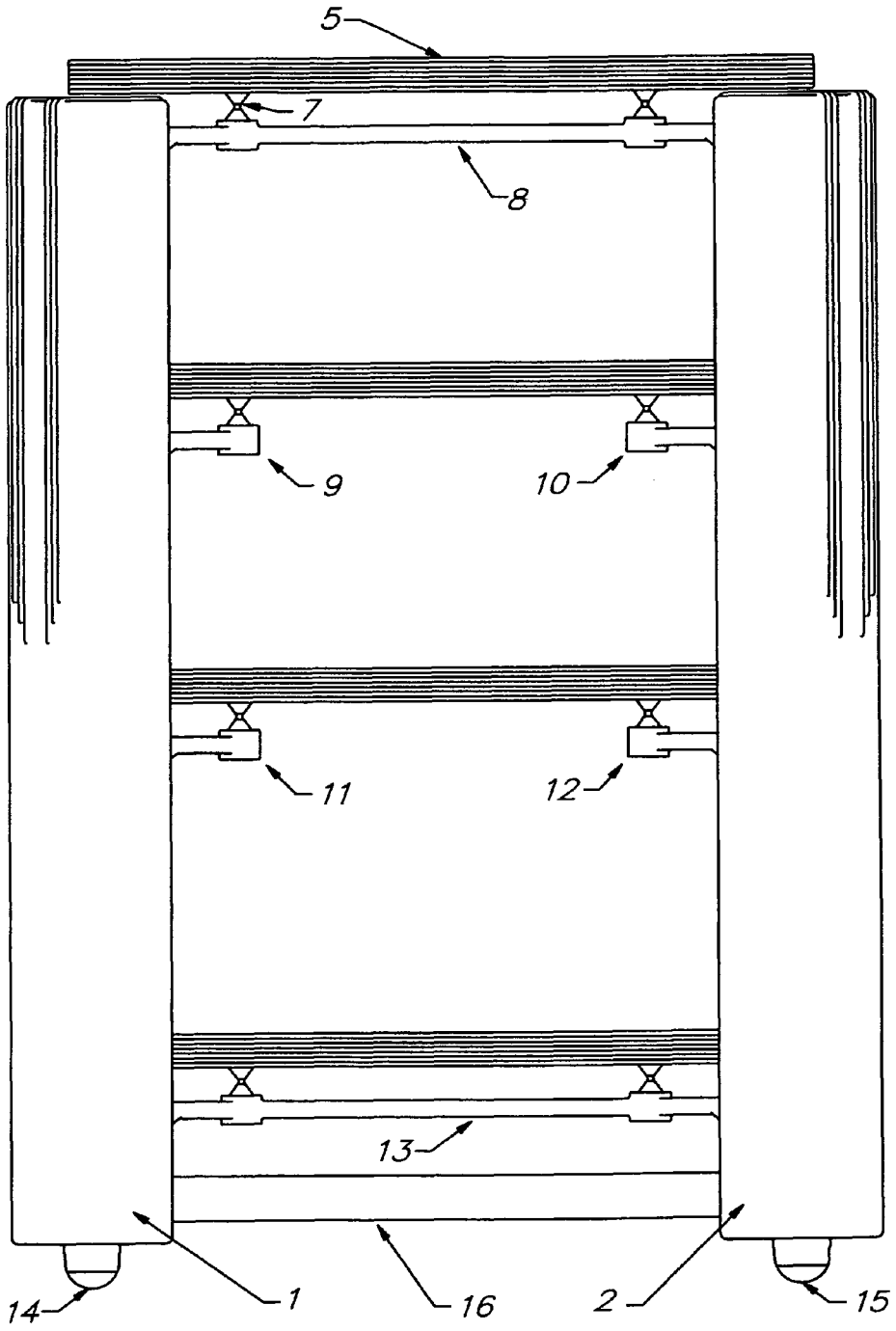
FIG. 1 is a front elevation of the present invention in a fully assembled form.

Reference to FIG. 1 represents the front elevation of this invention, thereby illustrating all assembled components essential in the functionality of the audio-video equipment stand. Commencing with the front left vertical support column 1 and front right vertical support column 2, both of which are machined from a metal alloy type material, accommodate sub frames 8 & 13, the manufacturing of which involves both casting and machining, are responsible for housing both the top most and bottom most audio-video equipment stand shelves, which are identical in specification throughout and are referenced as 5. Integral to the permanent housing of the audio-video equipment stand shelves is the conical point-to-point shelf support device 7 bound to the underside of the audio-video equipment stand shelves. Support brackets 9, 10, 11 & 12 are attached to the rear of the front vertical support columns 1 & 2, thereby providing support to the remaining audio-video equipment stand shelves. The front vertical support columns make contact with the ground, whereby support feet 14 & 15 are introduced in order to provide stability and adjustability to each of the front vertical support columns. At the base of the rear vertical support columns, of which there are two, which are not shown, is attached a cable manifold 16, which accommodates all the cable used in the provision of power to the receptacle power plants.

Figure 2:
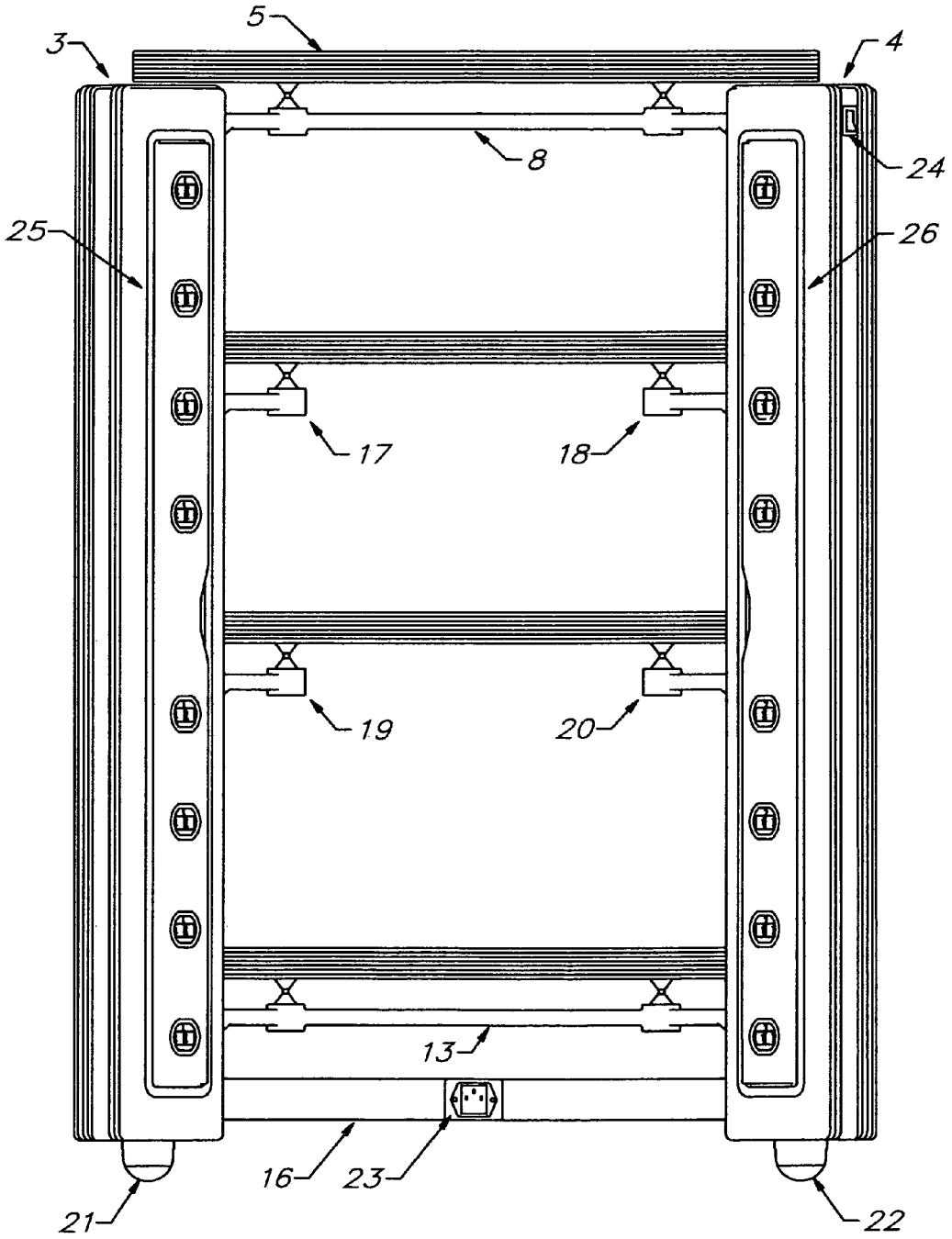
FIG. 2 is a rear elevation of the present invention in a fully assembled form.

Reference to FIG. 2 represents a rear elevation of this invention, illustrating all assembled components essential in the functionality of the audio-video equipment stand. Commencing with the rear left vertical support column 3 and the rear right vertical support column 4, both of which are machined from a metal alloy type material, accommodate sub frames 8 & 13, the manufacturing of which involves both casting and machining, are responsible for housing both the top most and bottom most audio-video equipment stand shelves. Support brackets 17, 18, 19 & 20 are attached to the rear of the rear vertical support columns 3 & 4, are installed in unison with support brackets 9, 10, 11 & 12, as depicted in prior reference FIG. 1, completing the support assembly for the remaining audio-video equipment stand shelves. The rear vertical support columns make contact with the ground, thereby support feet 21 & 22 are introduced in order to provide stability and adjustability to each of the rear vertical support columns. At the base of the rear left vertical support column 3 and the base of the rear right vertical support column 4 is the cable manifold 16 consisting ac receptacle inlet housing 23. The cable manifold is non load bearing thereby accommodating all relevant cabling used in the provision of power to each bank of receptacles, known as the receptacle power plants 25 & 26, both of which are housed separately within the rear vertical support columns 3 & 4, thereby maintaining their locality in accordance with the widest profile of each rear vertical support column to be the inside right of the rear left vertical support column 3 and the inside left of the rear right vertical support column 4. An on/off switch 24 is introduced in order to render both receptacle power units 25 & 26 operational or in operable when the isolation switch 24 is in the off position.

Figure 3:
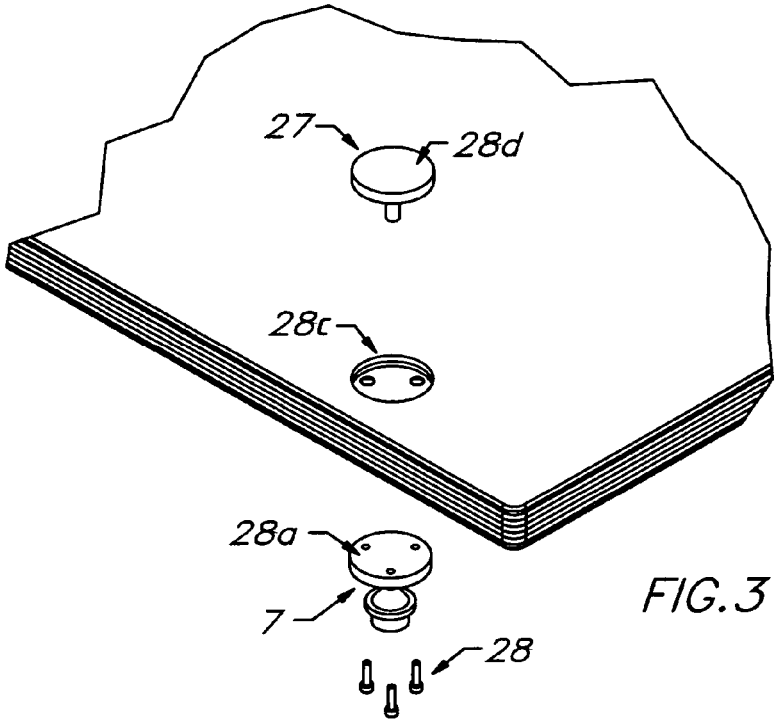
FIG. 3 is a top isometric illustration representing the departed shelf support assembly.
Figure 4:
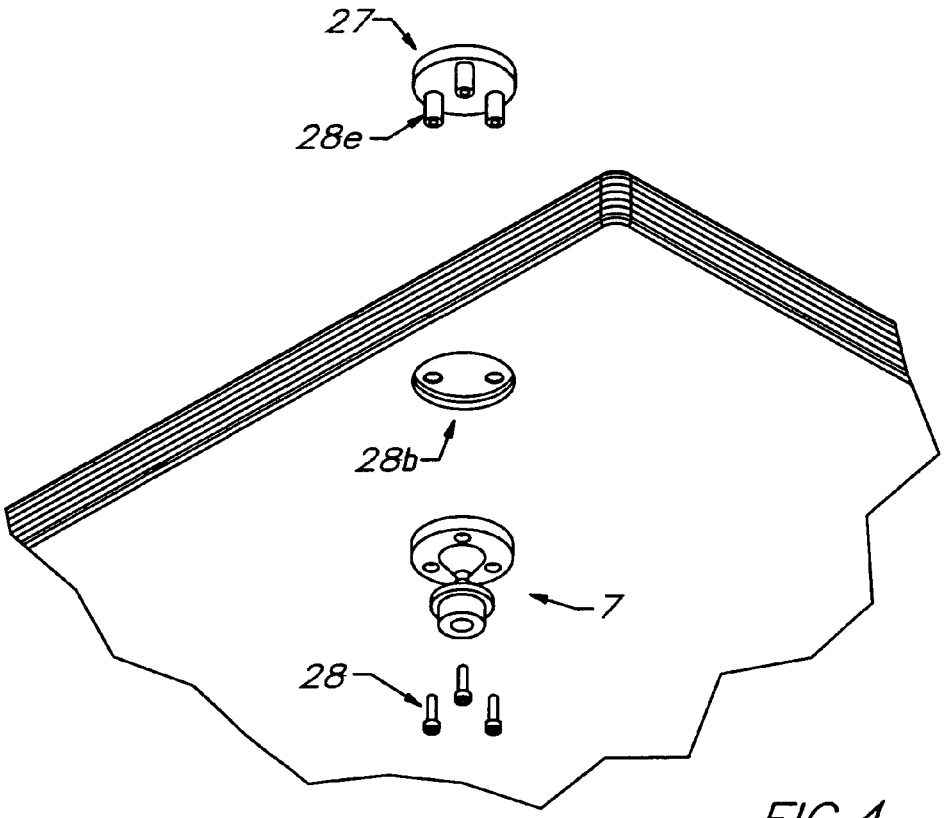
FIG. 4 is a bottom isometric illustration representing the departed shelf support assembly.

Reference to FIG. 3 & FIG. 4, commencing with FIG. 3, represents a top isometric blown assembly, illustrating the shelf support system, comprising: conical point-to-point shelf support device 7, which is machined from an alloy type material, is accommodated and secured to the underside of the audio-video equipment stand shelf courtesy of a circular recess 28*b* as featured in FIG. 4, which is equal in depth and diameter to the circular top extrusion 28*a* of the conical point-to-point shelf support device 7. Prior to the placement of the conical point-to-point shelf support device 7, the shelf support fixing plate 27 is offered into position, thereby occupying the circular recess 28*c* which is located to the top side of the shelf, is consistent in depth and diameter to the top circular extrusion 28*d* of the shelf support fixing plate 27. To ensure the precise mating of components 7 & 27, three holes which are referred to as insertion points of reference, are of equal diameter and distance to each other, traverse both recesses 28*b* & 28*c*.

The circular threaded extrusions 28*e* featured in FIG. 4, of which there are three, forms part of the fixing plate 27, occupy the insertion points of reference, thereby providing a fixing point of reference for the conical point-to-point shelf support device 7. There are three insertion points of reference located to the underside of the circular platform 28*a*, of the conical-point-to-point shelf support device 7, represented by three counter bored holes which fall into alignment with the fixing points of reference. The shelf support device 7, is offered into position in order to occupy the circular recess 28*b*. Three fixings 28 which are of a screw type, are screwed into the available fixing points of reference 28*e*, thereby permanently securing the conical point-to-point shelf support device 7 in place completing the shelf support assembly. Both conical point-to-point shelf support device 7 and shelf support fixing plate 27 make up the audio-video equipment stand shelf support system.

Figure 5:
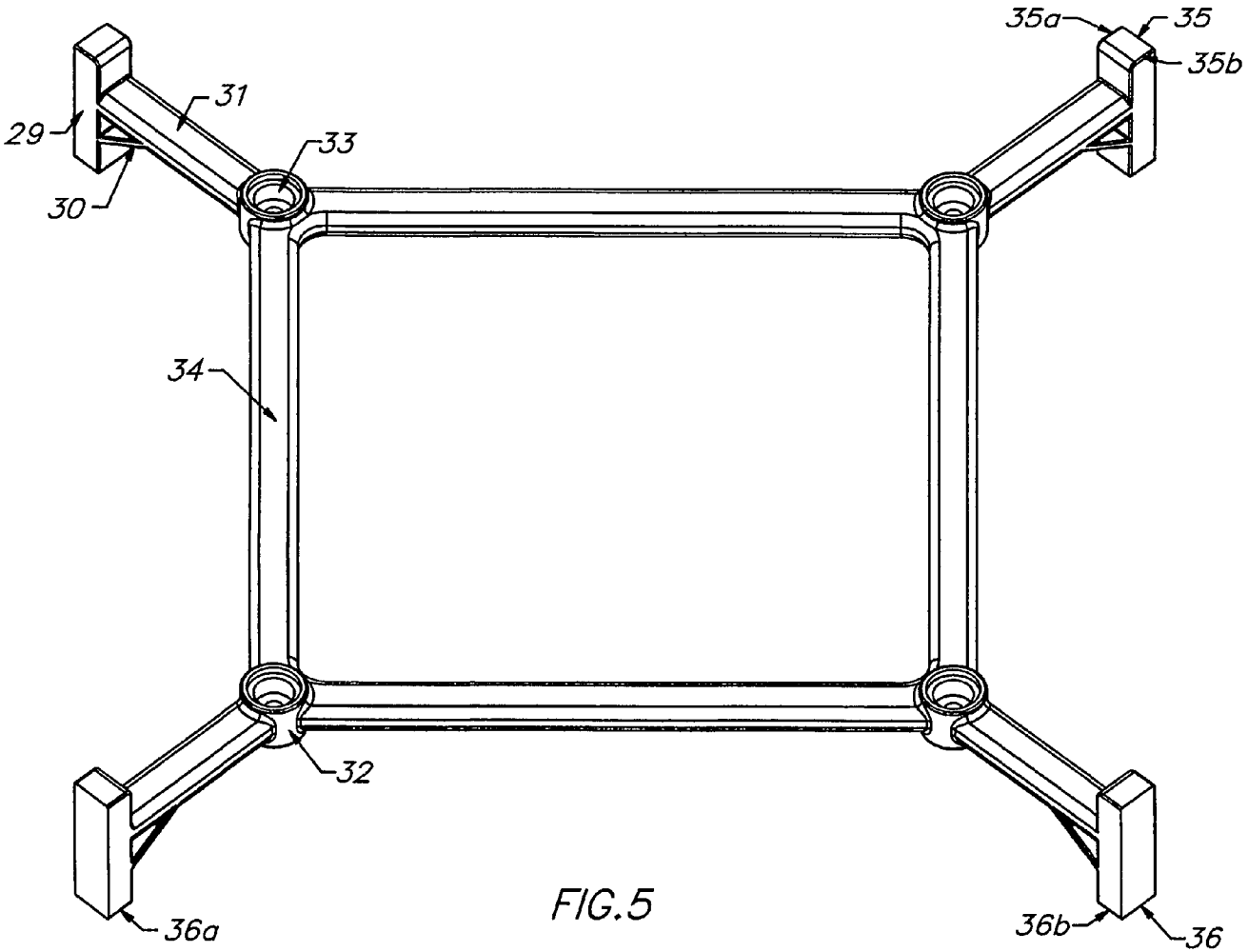
FIG. 5 is a top perspective view of the sub frame.
Figure 6:
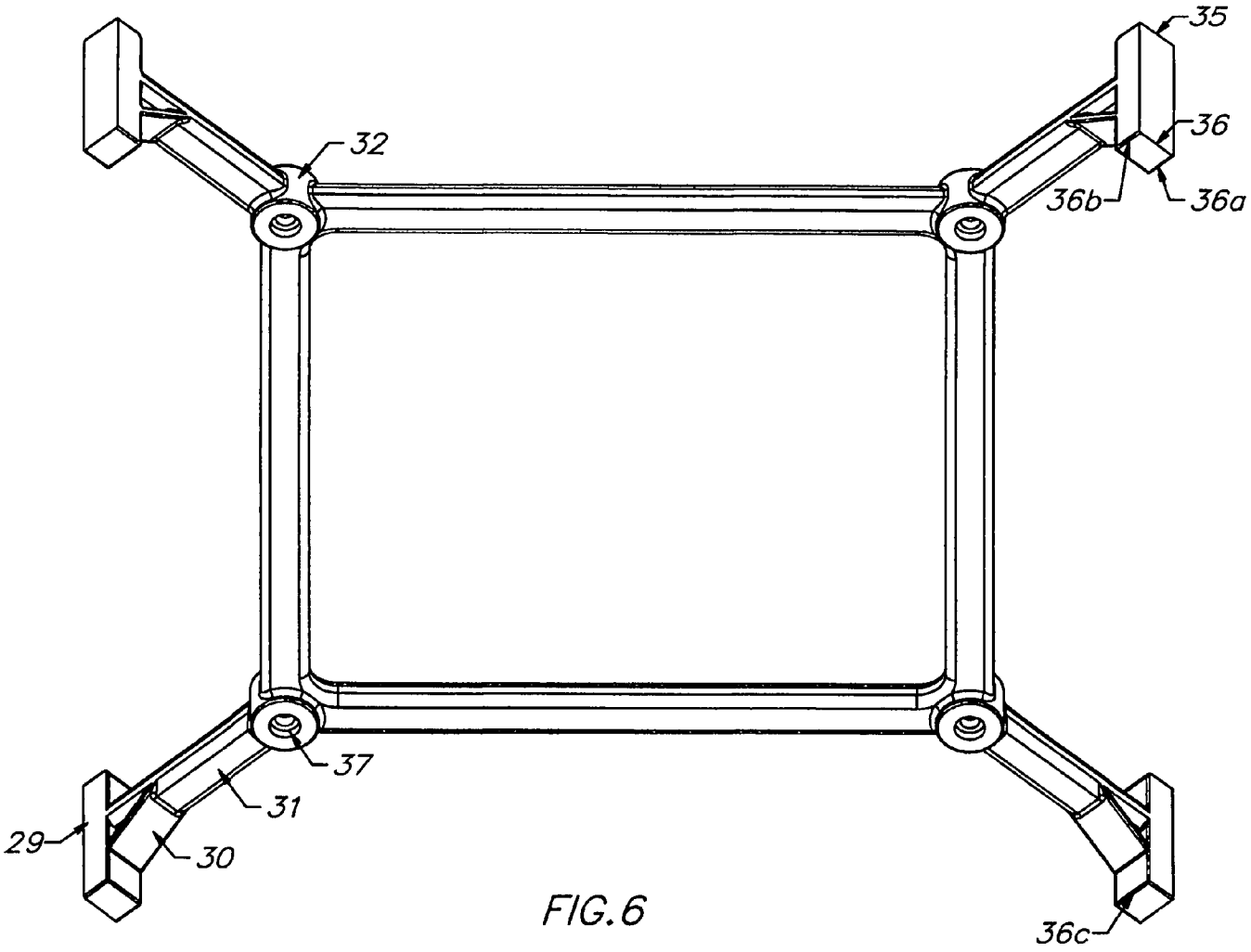
FIG. 6 is a bottom perspective view of the sub frame.

Reference to FIG. 5 and FIG. 6, commencing with FIG. 5, illustrate a top and bottom perspective view of the sub frame. The structural make up of the sub frame comprises: vertical support member 29, which sets in place and forms a permanent assembly with the audio-video equipment stand vertical support columns. The diagonal support member 30 forms an attachment, and thus a structural reinforcement between the vertical support member 29 and the horizontal support member 31. Integral to the functionality of the sub frame is the support body 32 which is a circular extrusion formed equal distance to the horizontal support member 31, along the y-axis. Insertion points of reference 33, of which there are four per sub frame, are responsible for housing the audio video equipment stand shelves, in particular the conical point-to-point support device, which forms part of the audio-video equipment stand shelf assembly. The sub frames bracketing structure, of which there are four per sub frame, is made up of items 29, 30, 31 & 32, plus an intermediary support member 34, of which there are four, forming an attachment to each sub frame bracket, support body formation, thereby creating a solid, rigid sub frame construction. Welds are used to permanently attach and retain the sub frames and the audio-video equipment stand vertical support columns to each other. The top most horizontal edges 35, 35*a* & 35*b*, associated with each vertical support member are a point of reference for the application of each weld, applicable to sub frame 8 & 13 represented in prior reference FIG. 1. FIG. 6 represents a bottom perspective view of the sub frame. The bottom most horizontal edges 36, 36*a* & 36*b* associated with each vertical support member, are additional points of reference for the application of each weld to the base of sub frame 8. Sub frame 13, as represented in prior reference FIG. 1, located at the base of the audio-video equipment stand, will be seated at the base of each inward extrusion associated with each vertical support column.

Figure 28:
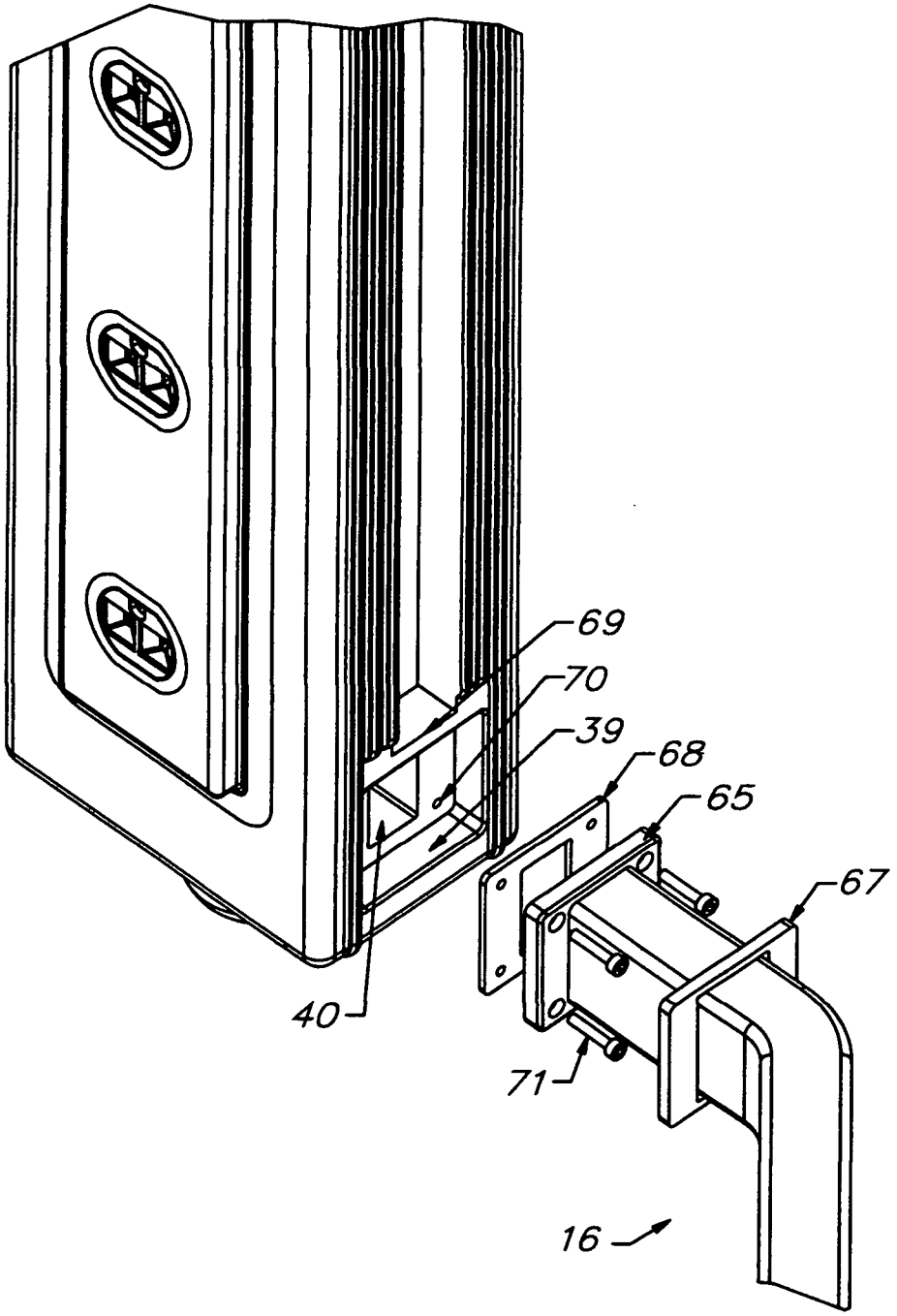
FIG. 28 is a isometric blown assembly illustration of the audio-video equipment stand cable manifold and rear vertical support column.

Welds will be applied to the top horizontal edges 35 35*a* & 35*b* of sub frame 13, with the base of the vertical support member of sub frame 13 receiving a single weld to the horizontal edge 36*c* in conjunction with the front base edge 69, which can be viewed in the forward reference FIG. 28, of each inward extrusion. Paramount to the permanent housing of each audio-video equipment stand shelf is a insertion point of reference 37, of which there are four. Each fixing, which is of a screw type when inserted, will occupy the insertion point of reference 37, thereby securing the audio-video equipment stand shelf permanently in place. The processes involved in the manufacture of the sub frames will include both casting and machining.

Figure 7:
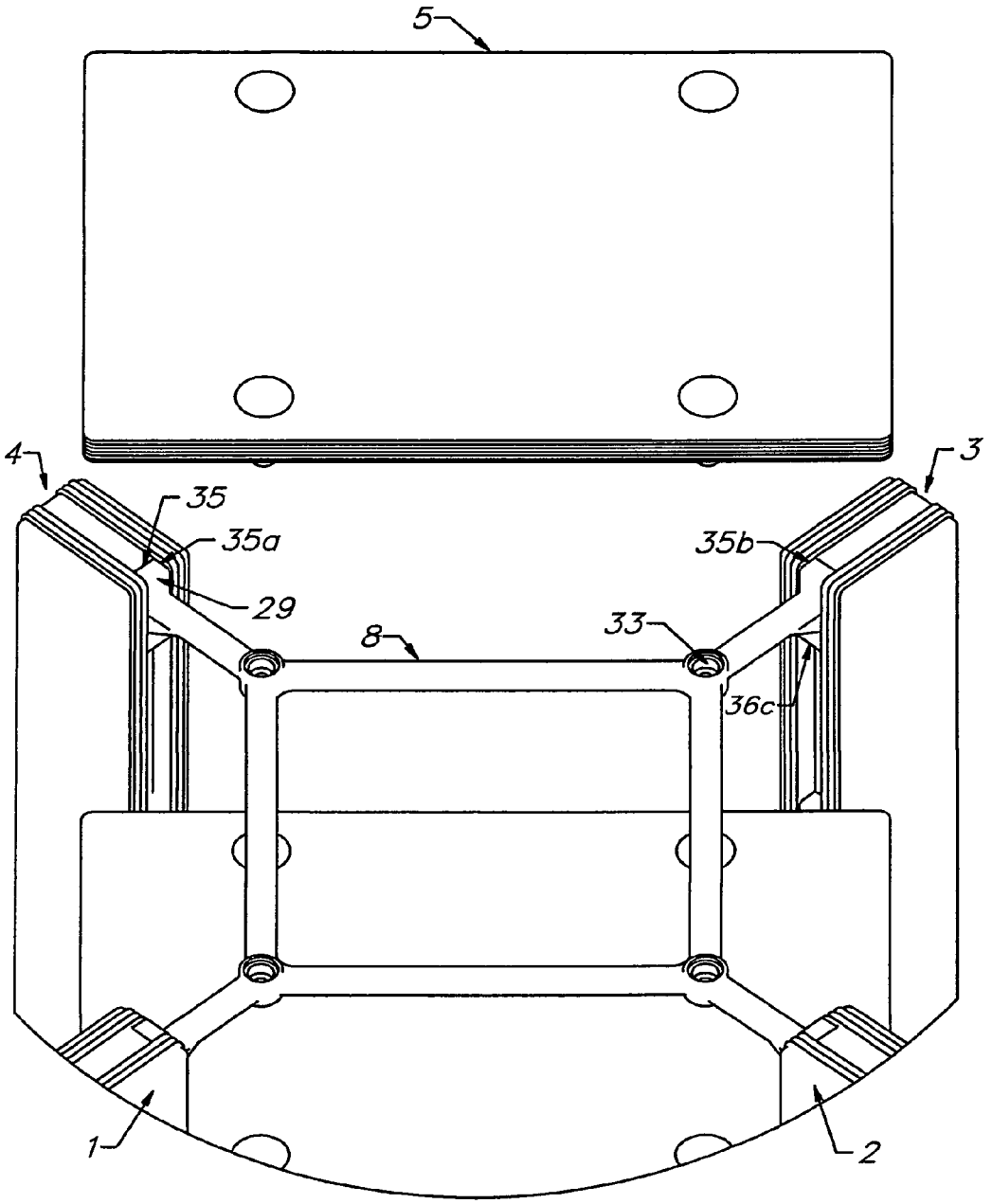
FIG. 7 is a perspective illustration representing the departed audio-video equipment stand top shelf from the top sub frame.
Figure 8:
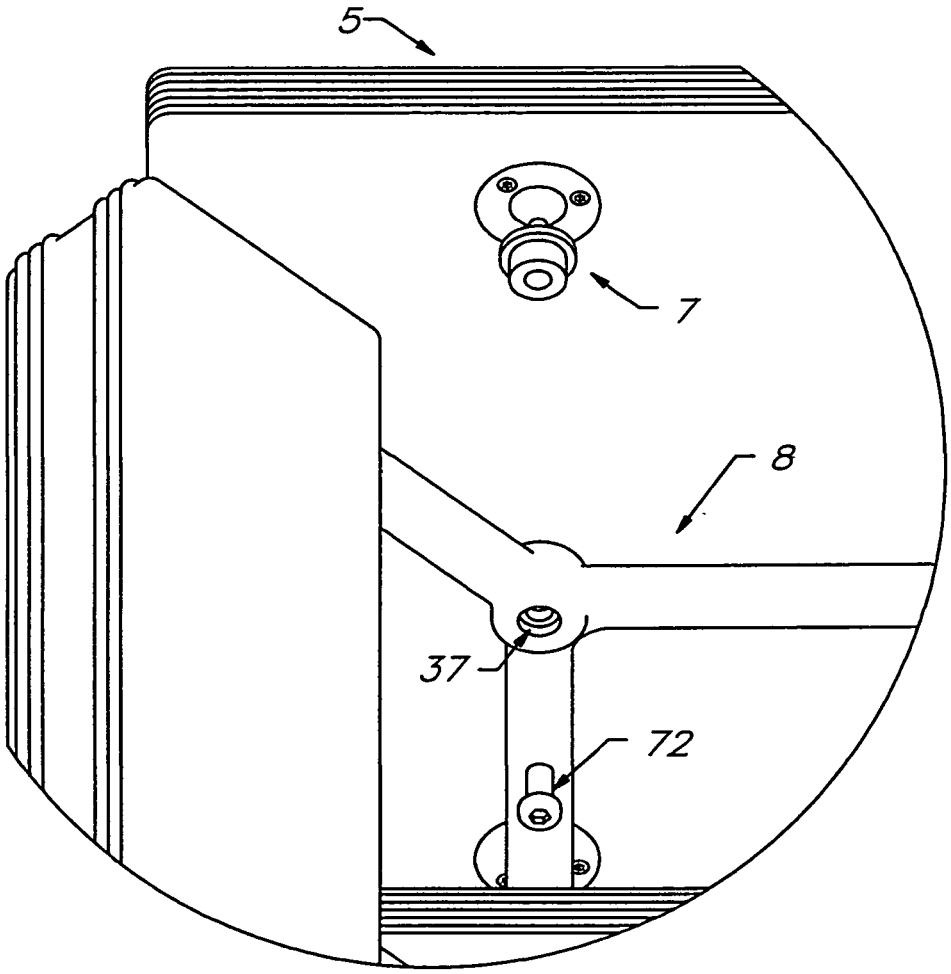
FIG. 8 is a perspective illustration of the general assembly and fixing arrangement between the top shelf and top sub frame.

Reference to FIG. 7 and FIG. 8 represent a departed perspective between the top most audio-video equipment stand shelf 5 and sub frame 8. Commencing with FIG. 7 which illustrates a departed assembly between the audio-video equipment stand shelf 5 and sub frame 8, which in conjunction with sub frame 13, which is not shown but depicted in prior reference FIG. 1, provides the structural rigidity of the audio video equipment stand. In this instance Sub frame 8 brings into alignment vertical support columns 1, 2, 3 & 4 at which point a weld is applied to the top, rear horizontal edges 35, 35*a* & 35*b* of the vertical support member 29 and the top most rear edge 64*b* of each inward extrusion, associated with each vertical support column, which can clearly be viewed in forward reference FIG. 17. In addition, each vertical support member 29, will receive a weld to the base of each vertical support member 29 whereby each weld will be applied to the base rear horizontal edges of the vertical support member 29, and the finished face, left and right side of the inward extrusion. The exact same process will be deployed in attaching sub frame 13, depicted in prior reference FIG. 1, to vertical support columns 1, 2, 3 & 4 with the exception of the base weld, which is to be applied to both the front edge 36*c* of the vertical support member, in conjunction with the front edge 69 of the inward extrusion, both of which are not shown, can be referenced in prior reference FIG. 6 & forward reference FIG. 28 respectively. Insertion points of reference 33, of which there are four, represented by a counter bored hole, house the audio-video equipment stand shelf 5. FIG. 8 is a bottom perspective blown assembly illustrating the fixing arrangement for the audio-video stand shelf, whereby the conical point-to-point support device 7, which is permanently bound to the underside of the audio-video equipment stand shelf 5, is offered into position, to be inserted into each of the four insertion point of reference. housing the audio-video equipment stand shelf 5 permanently in place, a fixing 72 which is of a screw type, is then applied to each of the four conical point-to-point support devices 7. A insertion point of reference represented in the form of a counter bored hole 37, receives the fixing 72, which when applied individually to each of the insertion points of reference 37, of which there are four, will secure the audio-video equipment stand shelf 5 permanently in place. The exact same procedure will be applied to sub frame 13, and the bottom most audio-video equipment stand shelf both of which are not shown, will thereby complete the assembly.

Figure 9:
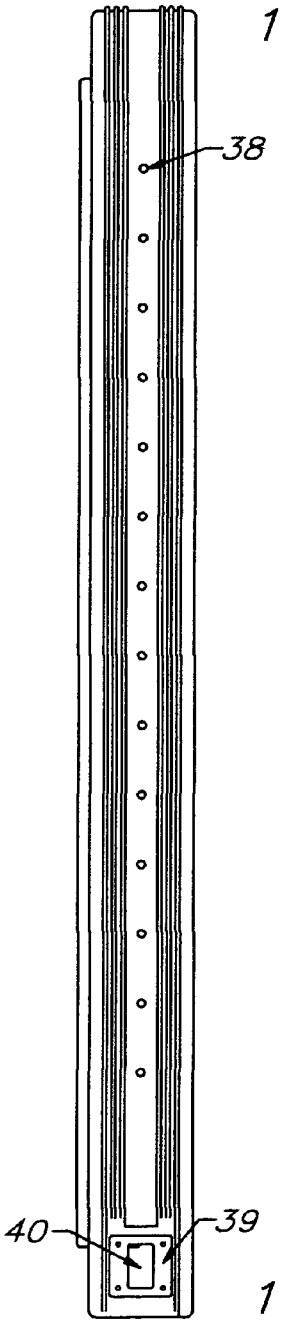
FIG. 9 is a rear elevation typical of both rear left and right audio-video equipment stand vertical support columns.
Figure 10:
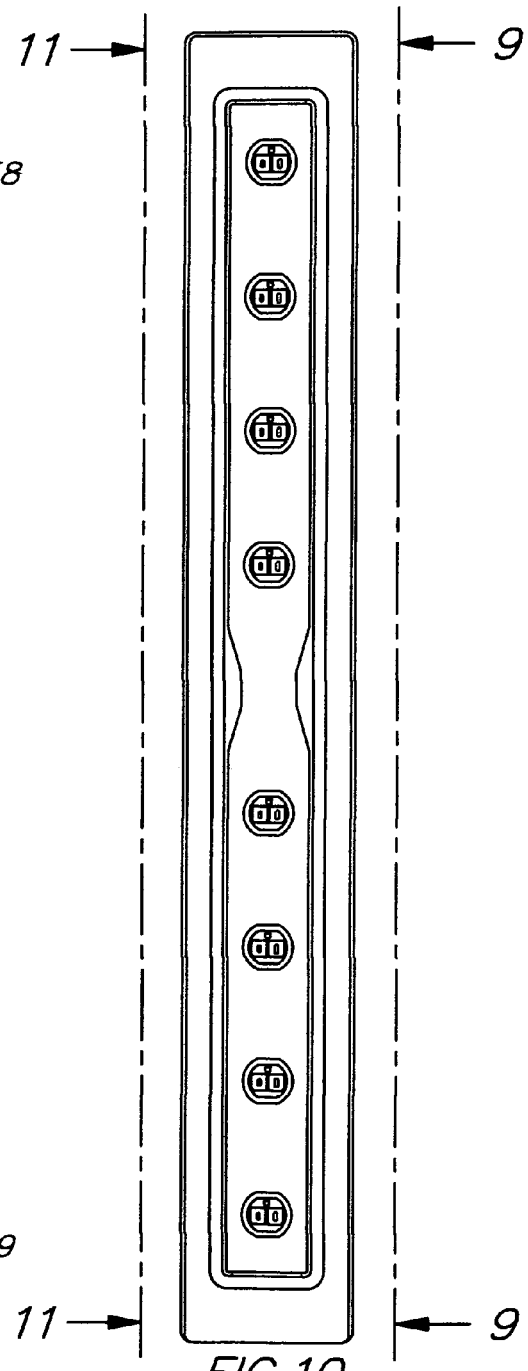
FIG. 10 is a side elevation typical of both rear left and right audio-video equipment stand vertical support columns.
Figure 11:
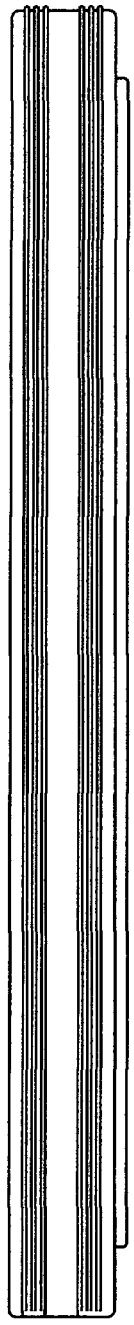
FIG. 11 is a front elevation typical of both rear left and right audio-video equipment stand vertical support columns.

Reference to FIG. 9, FIG. 10 & FIG. 11, commencing with FIG. 10, represents a front sided elevation typical of a rear vertical support column, complete with receptacle power plant. FIG. 9 illustrates the rear view of a rear vertical support column consisting fixing points of reference 38, of which there are fourteen per rear vertical support column, each representing a threaded hole, will be utilised by all support brackets 17, 18, 19 & 20, which are not shown, prior reference FIG. 2. The rear vertical support columns also house the cable manifold 16 which is not shown, prior reference FIG. 2. The rear vertical support columns have a recess 39, located at the bottom most aspect of each rear vertical support column. The recess 39 will accommodate the cable manifold 16, which is not shown, prior reference FIG. 2. An inward extrusion 40, extends beyond recess 39, thereby accommodating all cabling associated with the receptacle power plants. FIG. 11 is a typical front view of a rear vertical support column, illustrating the decorative extrusions associated with all vertical support columns.

Figure 12:
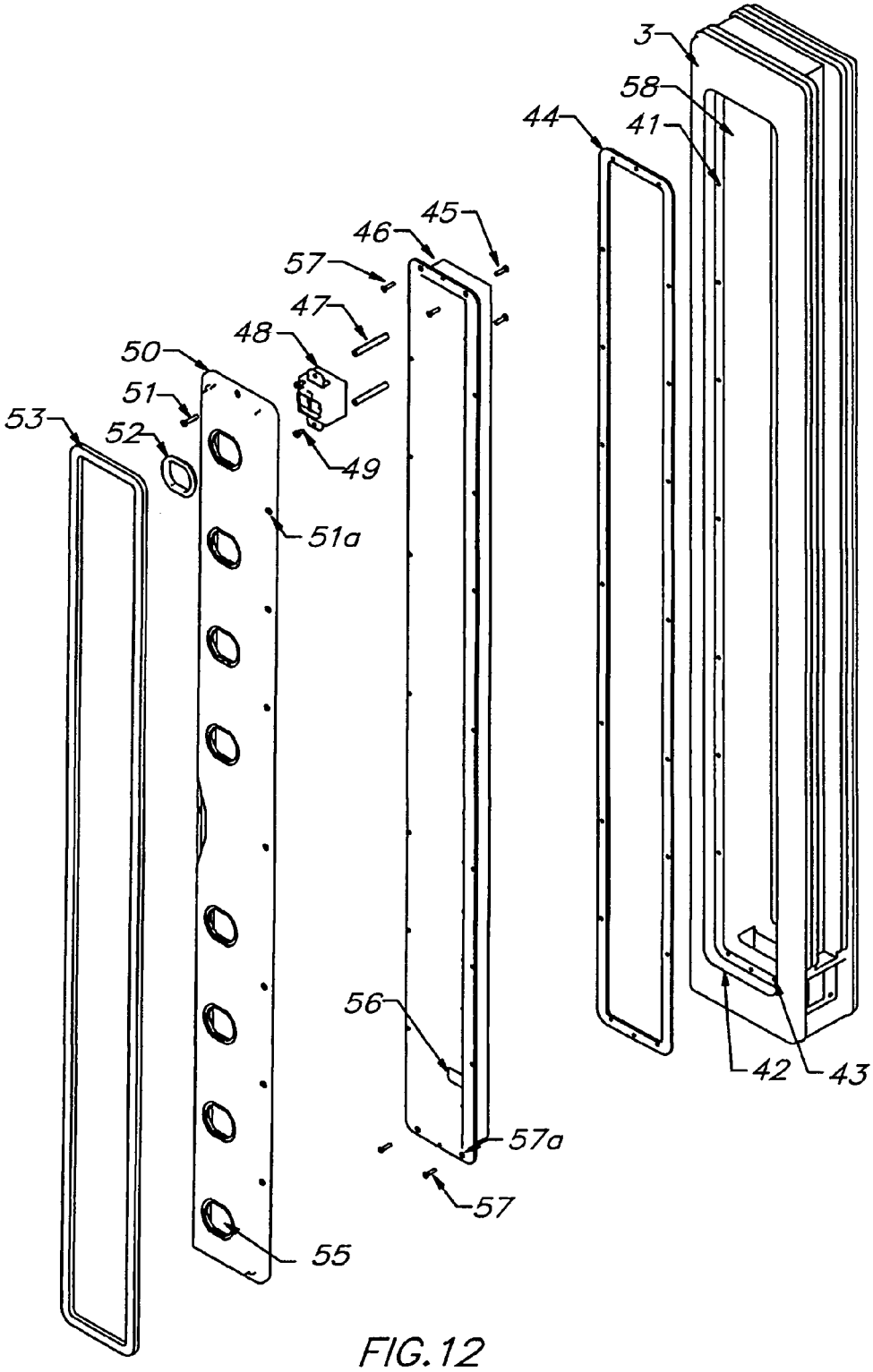
FIG. 12 is a isometric blown assembly typical of both rear left and right audio-video equipment stand vertical support columns.

Reference to FIG. 12 is a blown assembly illustrating all the key component parts which make up the receptacle power plants. Each receptacle power plant is assembled and housed within the rear vertical support columns of the audio-video equipment stand. In this instance, the left rear vertical support column 3, is used to illustrate the assembly. Vertical support column 3 has a recess 42, which is inward used for mounting all the component parts associated with the receptacle power plant. An internal seal 44, which is manufactured from a rubberised material, is introduced and set in place within recess 42, providing an enhanced fit and finish to all the assembled components. For the purposes of clarity, seven of the eight receptacles 48, which form a complete assembly, have been omitted. The following sequence reflects the order of assembly for the receptacle power plant commencing with the enclosure 46, which is to be formed from pressed metal, will provide a permanent housing for the receptacles 48. The enclosure 46, has sixteen countersunk holes, which are not shown, located to the back of the enclosure aligned vertically, equal distance to each other along the y-axis of the enclosure 46. The support posts 47, of which there are two per receptacle, are cylindrically constructed from a metal alloy material with a threaded hollow throughout, are offered into position enabling the countersunk fixings 45, of which there are one per support post, to be applied, thereby secure each support post 47, permanently in place within the enclosure 46. The receptacles 48, which are singular, are offered into position and mounted onto the support posts courtesy of fixing 49, of which there are two per receptacle. The aforementioned sequence of events is to be repeated for the remaining seven receptacles. The enclosure 46, is inward extruded of a pressed metal construction, thereby creates a wiring chamber that will accommodate all the wiring used to connect the receptacles 48. At the base of the enclosure is a rectangular aperture 56, which permits all cabling to be received into the wiring chamber.

Once these sequence of events have been completed, the enclosure with the assembled components will then be offered into place and seated within the recess 42. There are four Fixings 57, which will secure the enclosure into place. The fixings will occupy each of the insertion points of reference 57*a*, thereby securing the enclosure in place courtesy of the fixing points of reference 43, of which there are four, each positioned in close proximity to each corner of recess 42. Once these sequence of events have been completed, the next phase of the assembly will involve installing the receptacle cover plate 50, which is of a machined metal alloy construction, securely in place. The receptacle cover plate 50, contains eight apertures 55, which exposes each receptacle 48, whilst enclosing all internal assembled components. Each exposed receptacle will be consistent with the finished front face of the receptacle cover plate 50. When offered into position, the receptacle cover plate 50 will occupy the recess 42. The receptacle cover plate 50 will utilise the insertion points of reference 51*a*, which are represented by sixteen countersunk holes circumventing the perimeter of the receptacle cover plate 50. Each fixing 51, which is of a countersunk screw type, will then be applied, securing the receptacle cover plate in place, courtesy of the fixing points of reference 41 represented by sixteen holes, which are thread in nature and aligned in accordance with the sixteen insertion points of reference 51*a*, represented by the countersunk holes circumventing the receptacle cover plate 50. A receptacle perimeter trim 52 one per receptacle, manufactured from a rubberised material, is inserted into place thereby occupying each of the eight apertures 55. To complete the assembly an outer seal 53, manufactured from a rubberised material, is introduced and push fitted into position, completing the assembly. In order for each of the receptacle power plants to be housed without any impediment, the cavity 58 is present in each of the rear vertical support columns. Both the recess 42 and cavity 58 are machined, with a degree of tolerance, permissible in order to manoeuvre and secure all components into place.

Figure 13:
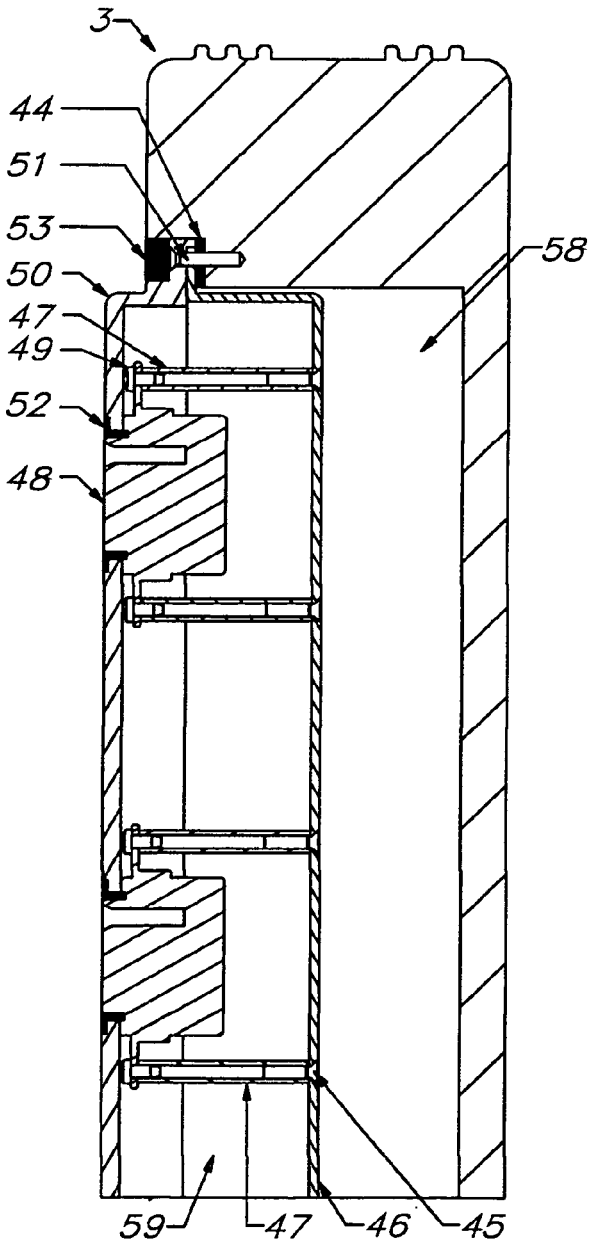
FIG. 13 is a partial section detail of a rear vertical support column and receptacle plant.
Figure 14:
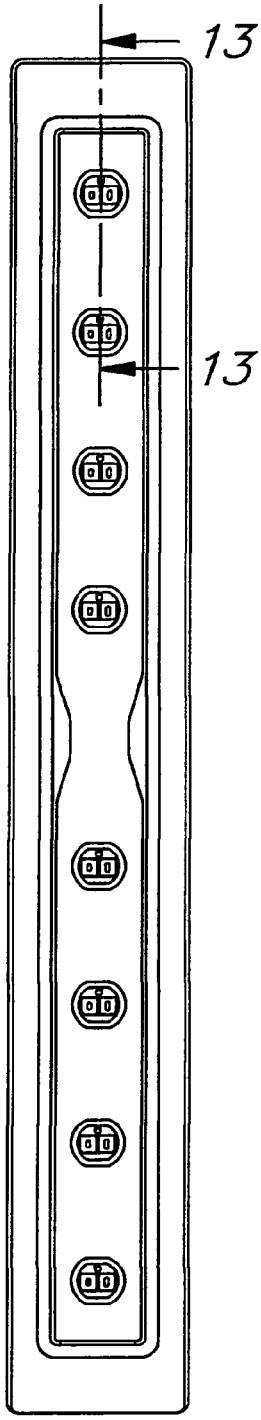
FIG. 14 is a side elevation typical of both rear left and right audio-video equipment stand vertical support columns.

Reference to FIG. 13 & FIG. 14, commencing with FIG. 13, represents a partial cross section typical of all assembled components which make up the receptacle power plant. In this instance, the left rear vertical support column 3, FIG. 14, is used to illustrate the cross section, which can be read in conjunction with the prior reference FIG. 12. FIG. 13 illustrates the internal seal 44, shown set in place, with the enclosure 46 mounted in place. The countersunk holes, of which there are sixteen, centrally align the back of the enclosure 46, and are occupied by the countersunk fixing 45 responsible for fixing permanently in place the support post 47, of which there are two per receptacle 48. Fixing 49, of which there are two per receptacle, attach each receptacle 48, to the support posts 47, of which there are two support posts per receptacle 48, thereby fixing the receptacles 48 permanently in place. The receptacle cover plate 50, is then offered into position and secured in place with countersunk type fixings 51, of which there are sixteen countersunk type fixings, will secure the whole receptacle power plant firmly in place. A receptacle perimeter trim 52, is inserted into place, and completing the assembly an outer seal 53 is push fitted into place, complementing the fit and finish of the assembly. The Cavity 58 has been machined with a degree of tolerance, permissible in order to manoeuvre and secure all components into place. The enclosures inward extrusion forms the wiring chamber 59, which accommodates all the wiring used in the connectivity and assembly of the receptacle power plants.

Figure 15:
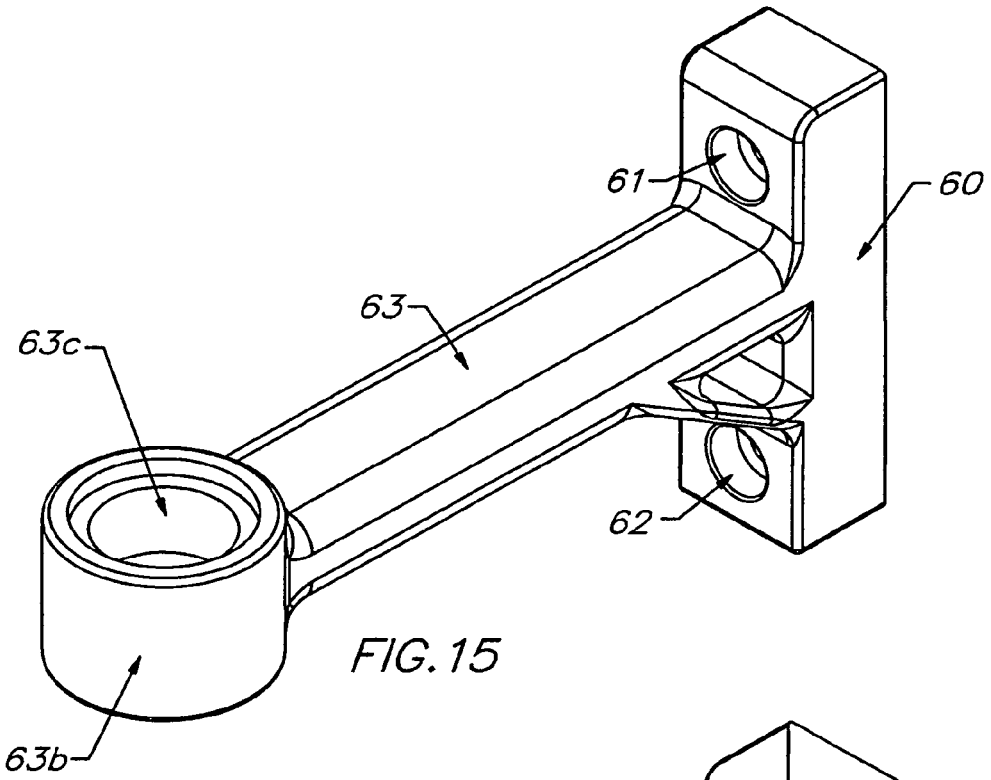
FIG. 15 is a top isometric illustration of the audio-video equipment stand shelf support bracket.
Figure 16:
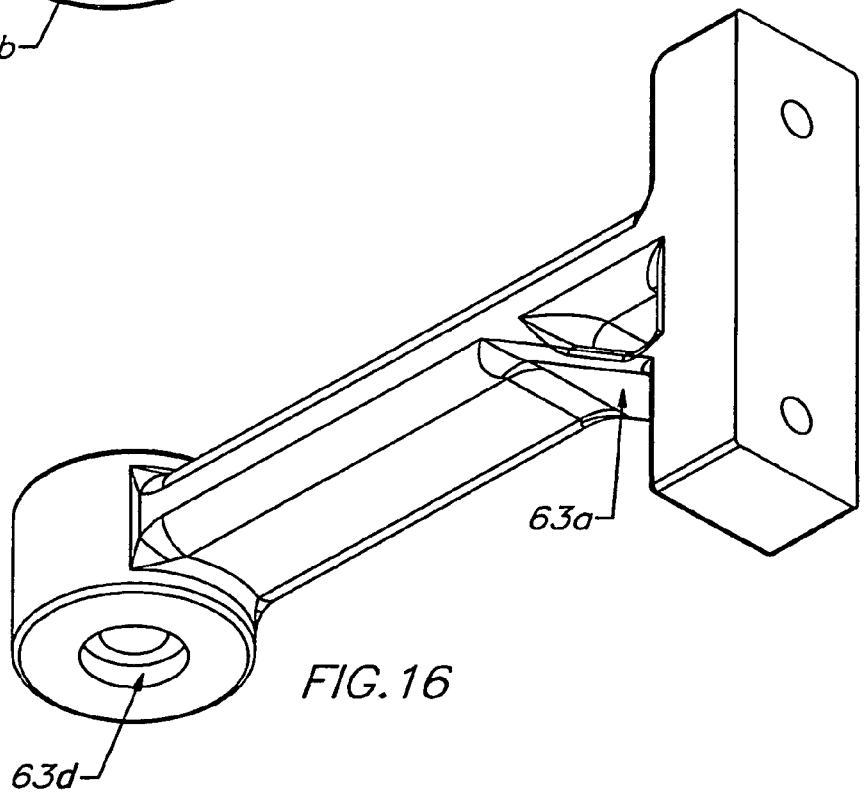
FIG. 16 is a bottom isometric illustration of the audio-video equipment stand shelf support bracket.

Reference to FIG. 15 & FIG. 16, commencing with FIG. 15, represent a top isometric view of the audio-video equipment stand shelf support bracket. Machined from a metal alloy type material, the shelf support bracket consists of a vertical support member 60, insertion points of reference, of which there are two, one located above the shelf support brackets horizontal member 63, represented by a counter bored hole 61, and the other insertion point of reference, represented by a counter bored hole 62, located below the diagonal support member 63*a* of the shelf support bracket. The support body 63*b*, is responsible for housing and fixing permanently in place the audio-video equipment stand shelves. 63*c* represents the insertion point of reference, in the form of a counter bored hole, responsible for housing the audio-video equipment stand shelves, in particular, the conical point-to-point shelf support device bound to the underside of each audio-video equipment stand shelf. FIG. 16 represents a bottom isometric view of the audio-video equipment stand shelf support bracket, which highlights the insertion point of reference 63*d*, represented by a counter bored responsible for accommodating a fixing, which is of a screw type used for fixing the audio-video equipment stand shelves permanently in place. The diagonal support member 63*d*, forms an attachment to the vertical support member 60 and horizontal member 63.

Figure 17:
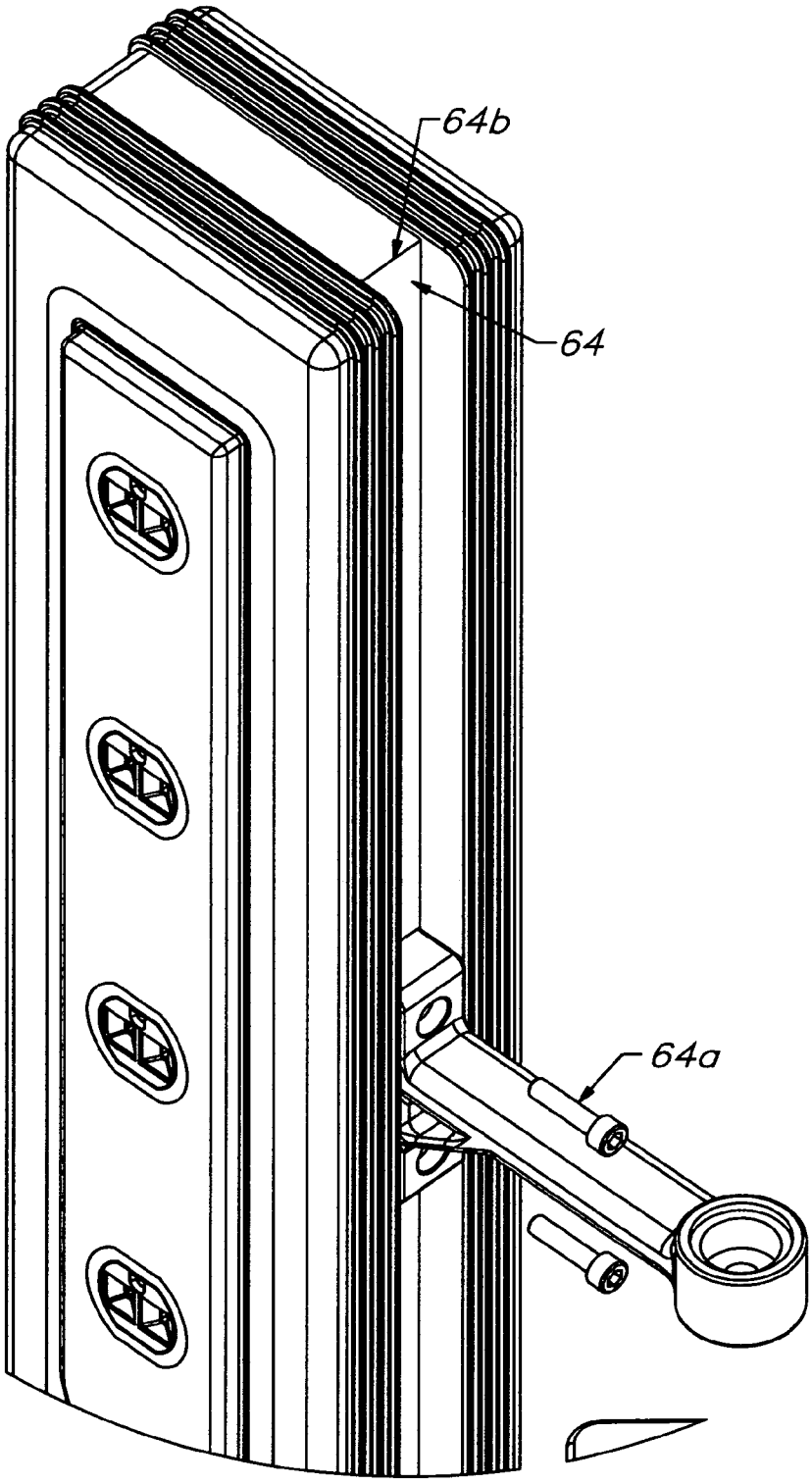
FIG. 17 is a isometric installation diagram of the audio-video equipment stand shelf support bracket.

Reference to FIG. 17 depicts the installation of the audio-video equipment stand shelf support bracket. Each support bracket is located within the audio-video equipment stand vertical support columns inward extrusion 64, and fixed in place courtesy of two fixings 64*a*, one of each occupying the insertion points of reference located on the vertical support member of the support bracket. The fixing arrangement is applicable to each of the following support brackets 9,10,11, 12 & 17,18,19,20 prior reference FIG. 1 and FIG. 2. The top most rear edge 64*b*, of each inward extrusion provides a welding point of reference associated with the top sub frame.

Figure 18:
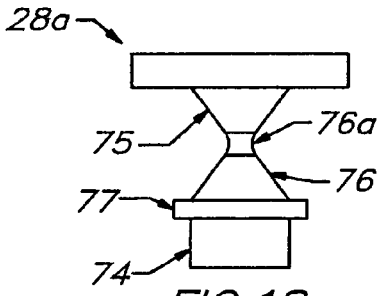
FIG. 18 is a front elevation of the conical point-to-point shelf support device.
Figure 19:
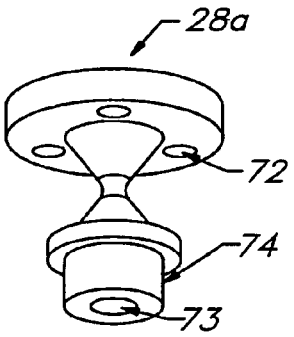
FIG. 19 is a bottom perspective view of the conical point-to-point shelf support device.
Figure 20:
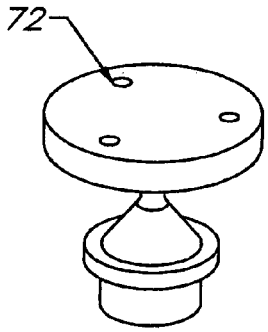
FIG. 20 is a top perspective view of the conical point-to-point shelf support device.

Reference to FIG. 18, FIG. 19 & FIG. 20 represent the conical point-to-point shelf support device. Commencing with FIG. 18, which illustrates a vertical front elevation of the conical point-to-point shelf support device, consisting: circular top extrusion 28*a* responsible for mating the conical point-to-point shelf support device to the underside of each audio-video equipment stand shelf, of which there are four conical point-to-point shelf support devices per shelf. The inverted cone 75, with the base of the inverted cone forming an attachment to the underside of the circular top extrusion 28*a*, is joined to a non inverted cone 76, which when joined at their pinnacle points, create an expanded girth 76*a*. The base of the none inverted cone 76, is therefore attached to a circular base extrusion 77, responsible for seating the conical point-to-point shelf support device within a insertion point of reference to be found on a sub frame support body, prior reference FIG. 5, and support bracket support body, prior reference FIG. 15. In order to fix the conical point-to-point shelf support device permanently in place, a circular extrusion 74, is formed to the underside of the circular base extrusion 77. FIG. 19 illustrates a perspective view of the underside of the conical point-to-point shelf support device. The insertion points of reference 72, located to the underside of the circular top extrusion 28*a*, are represented by counter bored holes, of which there are three, will accommodate the fixings, which are of a screw type, thus securing each conical point-to-point support device to the underside of each audio-video equipment stand shelf, prior reference FIG. 4. The fixing point of reference 73, represented by a threaded hole, is responsible for permanently fixing in place the conical point-to-point shelf support device. A fixing, which is of a screw type, occupies a insertion point of reference which is to be found on the underside of the sub frame prior reference FIG. 8, and support bracket prior reference FIG. 16. FIG. 20 depicts a top perspective view of the conical point-to-point shelf support device highlighting the insertion points of reference 72, which emanate from the underside of the circular top extrusion 28*a*. The conical point-to-point support device is to be manufactured from a metal alloy type material, utilising a machining process of manufacture.

Figure 21:
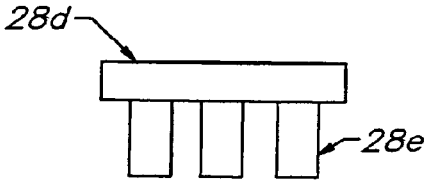
FIG. 21 is a front elevation of the conical point-to-point shelf support fixing plate.
Figure 22:
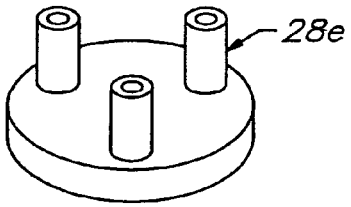
FIG. 22 is a inverted prospection of the conical point-to-point shelf support fixing plate.
Figure 23:
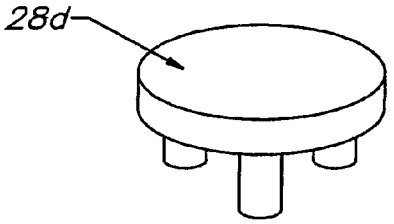
FIG. 23 is a top perspective illustration of the conical point-to-point shelf support fixing plate.

Reference to FIG. 21, FIG. 22 & FIG. 23, represent the conical point-to-point shelf support fixing plate, used to bind the conical-point-to-point shelf support device permanently in place to the underside of the audio-video equipment stand shelves. Utilising a machining process of manufacture, the fixing plate, featuring three threaded cylindrical extrusions 28*e*, emanating from the underside of the circular top extrusion 28*d*, provide fixing points of reference, which will be utilised by the respective fixings associated with the conical-point-to-point shelf support device prior reference FIG. 3 & FIG. 4. The conical point-to-point shelf support fixing plate is inserted downwards in accordance with the y-axis, thereby occupy circular recesses, of which there are four, located to the topside of the audio-video equipment stand shelf. The conical-point-to-point shelf support device will be offered into position to the underside of audio-video equipment stand shelf and fixed permanently in place courtesy of fixings, which are of a screw type, accommodated by the threaded cylindrical extrusions 28*e*.

Figures 24, 25, 26, 27:
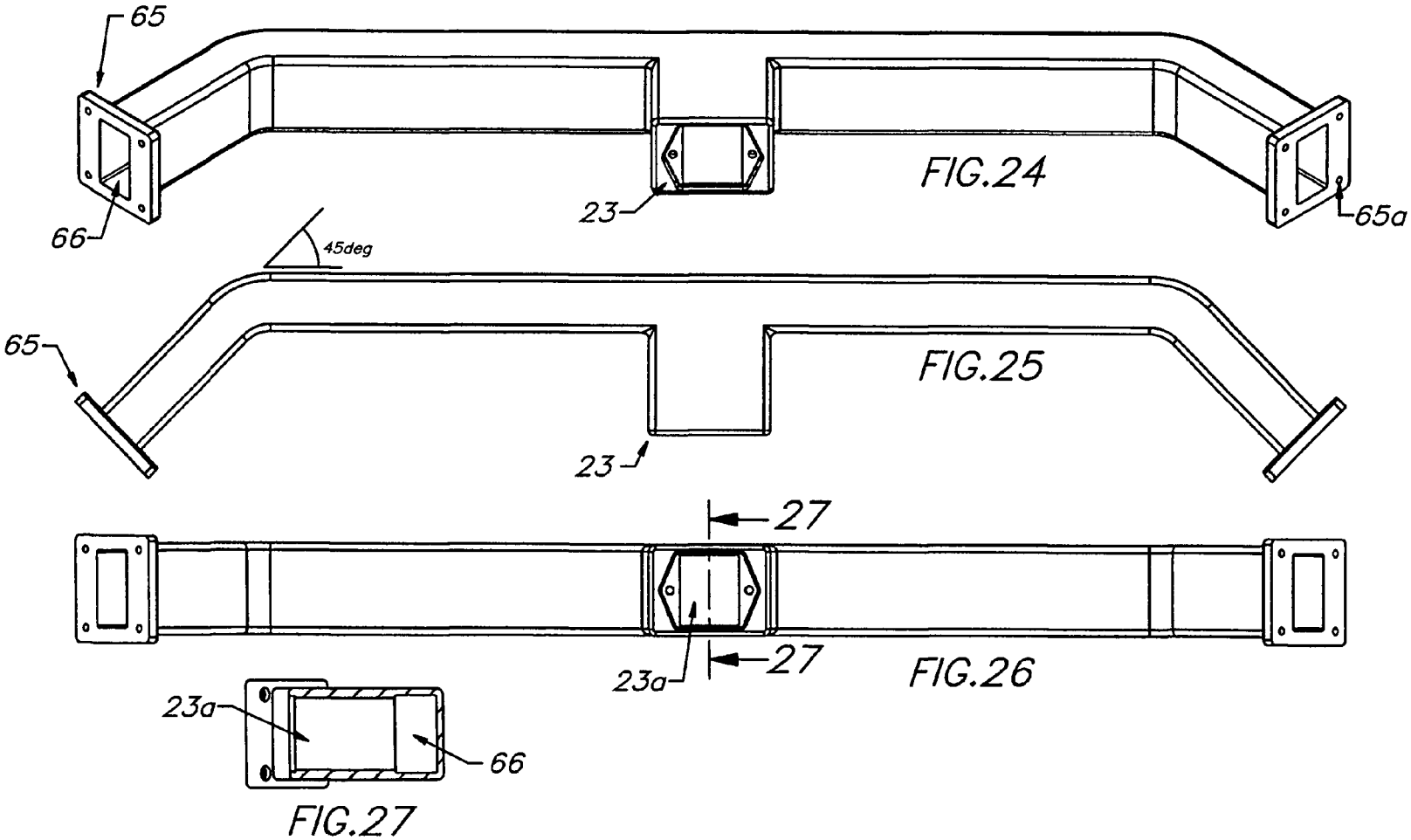
FIG. 24 is a top perspective illustration of the audio-video equipment stand cable manifold.
FIG. 26 is a front elevation of the audio-video equipment stand cable manifold.
FIG. 27 is a cross section of the audio-video equipment stand cable manifold to include the ac receptacle housing.

Reference to FIG. 24, FIG. 25, FIG. 26 & FIG. 27, illustrates the audio-video equipment stand cable manifold. Commencing with FIG. 24, which represents a top perspective view of the cable manifold. Utilising a casting process, the cable manifold is to be manufactured from a metal alloy type material. The structural features of the cable manifold comprise a longitudinal, rectangular body which is channelled throughout thereby forming the main conduit 66, which accommodates all cabling used in the connectivity and general assembly of all components associated with the receptacle power plants. The audio-video equipment stand cable manifold has a ac receptacle housing 23, which accommodates an ac receptacle inlet used for connecting the audio-video equipment stand to an appropriate power source. A flange 65, of which there are two, located at either end of the cable manifold, provide a fitting arrangement which secures the cable manifold, courtesy of the insertion points of reference 65*a*, of which there are four per flange, to the audio-video equipment stand rear vertical support columns. FIG. 25 represents a plan view of the cable manifold depicting the ac receptacle housing 23. The cable manifold is longitudinal with a altered geometry characterised by the forty five degree angulated body, which is consistent at either end of the cable manifold, whereby a flange 65, of which there are two, are formed at either end. FIG. 26 represents the front elevation of the cable manifold. When set in place, the cable manifold will maintain the angulated stylisation of the audio-video equipment stand. FIG. 27 represents section 27 as shown in the prior depiction FIG. 26, illustrating a cross section incorporating the main conduit 66, which is channelled throughout and the adjoining inward extrusion 23*a* responsible for accommodating the ac receptacle inlet.

Reference to FIG. 28 illustrates a blown isometric assembly of the cable manifold. The cable manifold 16, forms an attachment with each of the audio-video equipment stand rear vertical support columns, courtesy of the recess 39, located at the bottom most aspect of each vertical support column, provides a housing for the cable manifold, commencing with the cable manifold seal 68, manufactured from a rubberised material, is located within the recess 39, providing a seating and fitting arrangement for the cable manifold flange 65, which when offered into position will occupy the recess 39, fixed permanently into position courtesy of the fixings 71 which are of a screw type, four per cable manifold flange, all of which occupy a fixing point of reference 70, which is a inward extruded thread hole, of which there are four thereby accommodating each fixing 71. An inward extrusion 40, rectangular in shape, extends beyond recess 39, thereby accommodating all cabling associated with the receptacle power plants. The inward extrusion 40, is contiguous with the hollow, channelled, conduit type feature associated with the cable manifold thereby ensuring all cabling associated with the audio-video equipment stand will be accommodated within the cable manifold 16. An external seal 67, which is manufactured from a rubberised material will be push fitted into position, occupying recess 39, thereby completing the assembly. When fully assembled, the left rear and right rear audio-video equipment stand vertical support columns will be aligned to an angle of forty five degrees, in keeping with the angulated feature of the cable manifold. In compliance with the angulated setting of the left rear and right rear audio-video equipment stand vertical support columns, the top most sub frame 8, prior reference FIG. 7, and in this instance the bottom most sub frame 13, prior reference FIG. 2, will maintain the angulated setting of the left rear and right rear audio-video equipment stand vertical support columns, courtesy of the welds which are applied to each of the vertical support members horizontal edges 35, 35*a* and 35*b* prior reference FIG. 5 and in this instance the bottom most horizontal edge 36*c* prior reference FIG. 6, in conjunction with the bottom most front facing edge 69, of each inward extrusion, associated with the front left and right and rear left and right audio-video equipment stand vertical support columns.

Figure 29:
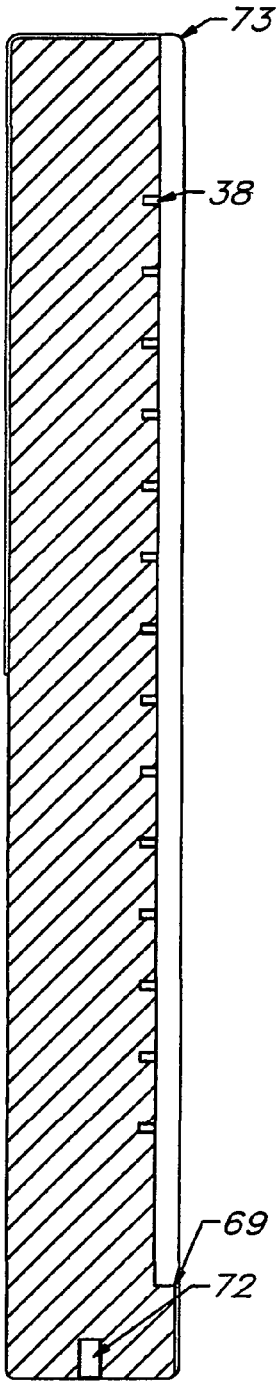
FIG. 29 is a vertical cross section typical of a audio-video equipment stand front vertical support columns.
Figure 30:
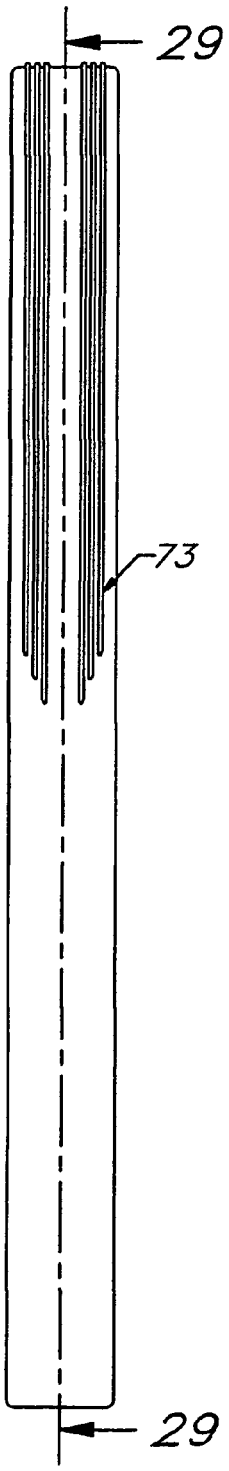
FIG. 30 is a typical front elevation of the audio-video equipment stand front vertical support columns.
Figure 31:
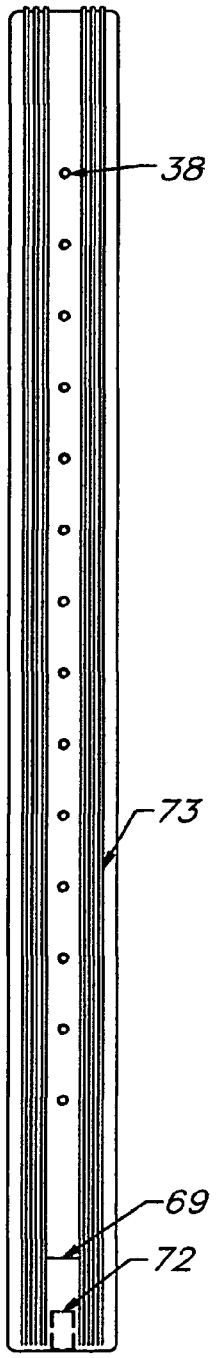
FIG. 31 is a typical rear elevation of the audio-video equipment stand front vertical support columns.

Reference to FIG. 29, FIG. 30 & FIG. 31, all of which illustrate the audio-video equipment stand front vertical support column, typical of the front left and front right vertical support columns. Commencing with FIG. 29, which illustrates a vertical cross section in accordance with the y-axis of the front vertical support column, which is structurally solid throughout, machined from a metal alloy type material, depicts the fixing points of reference 38, of which there are fourteen, represented by a bored circular threaded hole, will accommodate the audio-video equipment stand shelf support brackets which are not illustrated. The threaded stud which forms part of the adjustable support feet, which is not illustrated, will be located within the bored circular threaded hole 72, symmetrically located at the base of each audio-video equipment stand vertical support column. The audio-video equipment stand vertical support columns exhibit decorative extrusions 73, which circumvent each of the audio-video equipment stand vertical support columns. The bottom most front facing edge 69, of the inward extrusion, represents a welding point of reference, which will permit a weld to be applied between the vertical support members of the base sub frame, prior reference 36*c* FIG. 6, and the audio-video equipment stand front vertical support columns. FIG. 30 is a front elevation of the front vertical support column typical of both left and right audio-video equipment stand vertical support columns depicting the vertical cross section 29 in accordance with prior reference FIG. 29, and a front view of the decorative extrusion 73. FIG. 31 is a rear view of the audio-video equipment stand vertical support column depicting the fixing points of reference 38 represented by a bored circular threaded hole, decorative extrusions 73, bored circular threaded hole 72, symmetrically located at the base of each audio-video equipment stand vertical support columns and the bottom most front facing edge 69 of the inward extrusion, which will provide a welding point of reference, thereby providing a weld between the vertical support members of the base sub frame, prior reference 36*c* FIG. 6 and the audio-video equipment stand front vertical support columns.

Figure 32:
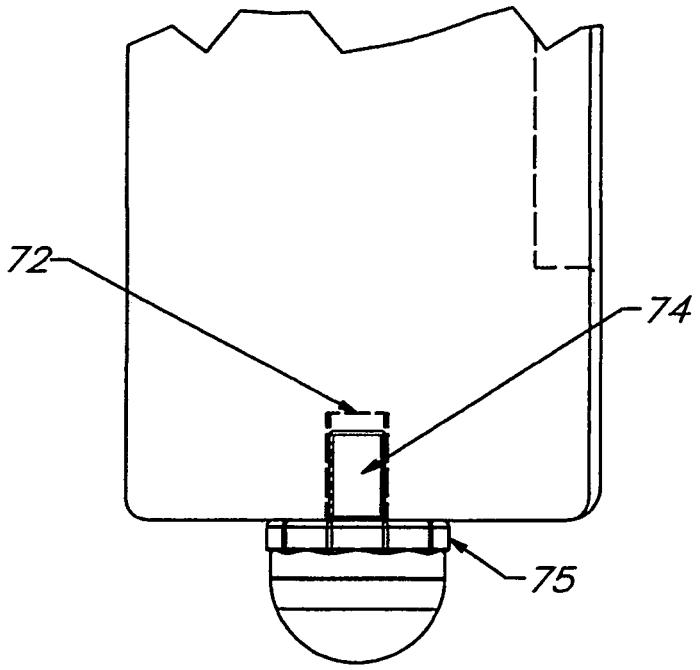
FIG. 32 is a typical detail representation of the audio-video equipment stand vertical support columns support feet.

Reference to FIG. 32 illustrates the audio-video equipment stand vertical support column support feet located at the base of each audio-video equipment stand vertical support columns, courtesy of the bored circular threaded hole 72 symmetrically located at the base of each audio-video equipment stand vertical support column, which accommodates the threaded stud element 74, of the support feet, which are adjustable due to the rotational manipulation crown 75. The support feet will be formed in every respect from a metal alloy type material, in keeping with a machining process.

The invention claimed is:

1. A stand, comprising:

a plurality of vertical support columns including at least two front and at least two back vertical support columns, each of the at least two back vertical support columns includes a plurality of vertically arranged electrical receptacles;

an upper sub-frame and a lower sub-frame, the upper sub-frame and lower sub-frame each having a plurality of vertical support members where each one of the plurality of vertical support members is mounted to a respective one of the plurality of vertical support columns, a respective one of a plurality of horizontal support members extends from each of the vertical support members generally toward a center of the stand to a respective one of a plurality of support body segments, each one of the support body segments having a vertical insertion point, a plurality of intermediary support members where a respective one of the intermediary support members is disposed between successive support body segments around an inner perimeter of the upper and lower sub-frames, the vertical support members of the upper sub-frame being attached at an upper portion of the respective vertical support columns, and the vertical support members of the lower sub-frame being attached at a lower portion of the respective vertical support columns;

an upper shelf having a plurality of support devices extending downward from a bottom of the upper shelf and located in correspondence with a respective one of the support body segments of the upper sub-frame; and a lower shelf having a plurality of support devices extending downward from a bottom of the lower shelf and located in correspondence with a respective one of the support body segments of the lower sub-frame.

2. The stand of claim 1, wherein each of the vertical support columns are oriented toward the center of the stand along a width of the vertical support column.

3. The stand of claim 1, further comprising:

a set of support brackets each having a vertical support member mounted to a respective one of the vertical support columns, a horizontal support member extending from the vertical support member towards the center of the stand, and a support body at an end of the horizontal support member, wherein each of the set of support brackets are mounted at the same height between the upper and lower sub-frames; and a mid-shelf having a plurality of support devices extending downward from a bottom of the mid shelf and located in correspondence with a respective one of the support bodies of the set of support brackets.

4. The stand of claim 1, further comprising a cable manifold connected between the at least two back vertical support columns at a bottom of the at least two back vertical support columns, and including a receptacle for receiving electrical power that is electrically connected to the vertically arranged receptacles in the at least two back vertical support columns.

5. The stand of claim 4, wherein the cable manifold is angled towards the center of the stand from each of the at least two back vertical support columns.

6. The stand of claim 1, further comprising, on the upper and lower shelves, a plurality of fixing plates, each of the plurality of fixing plates disposed in a respective recess in a top surface of the upper and lower shelves over a respective one of the plurality of support devices, wherein the support devices are attached to the fixing plates through the respective upper and lower shelves.

7. The stand of claim 1, wherein each of the support devices comprise an inverted cone portion over a non-inverted cone portion.

8. The stand of claim 1, further comprising an on/off switch on one of the at least two back support columns that controls power to the plurality of vertically arranged electrical receptacles.

9. The stand of claim 1, further comprising a plurality of adjustable feet, each of which is disposed on a bottom of a respective one of the plurality of vertical support columns.

10. A stand for audio visual equipment, comprising:

four vertical support columns including two front vertical support columns and two back vertical support columns, wherein each of the four vertical support columns are disposed at a respective corner of the audio visual stand, and wherein each of the four vertical support columns are angled towards a center of the audio visual stand along a horizontal width of the respective vertical support column;

an upper sub-frame rigidly connected to each of the four vertical support columns at an upper portion of each of the four vertical support columns;

a lower sub-frame rigidly connected to each of the four vertical support columns at a lower portion of each of the four vertical support columns;

the upper and lower sub-frames each having four vertical support members that are each coupled to a respective one of the four vertical support columns, four horizontal support members each extending from a respective one of the vertical support members towards the center of the audio visual stand, four support body segments each of which are formed at an end of a respective one of the horizontal support members and which are connected in succession by four intermediary support members; and an upper shelf having a plurality of support devices extending downward from a bottom of the upper shelf and located in correspondence with a respective one of the support body segments of the upper sub-frame; and a lower shelf having a plurality of support devices extending downward from a bottom of the lower shelf and located in correspondence with a respective one of the support body segments of the lower sub-frame.

11. The stand of claim 10, further comprising an adjustable foot disposed on a bottom of each of the four vertical support columns.

12. The stand of claim 11, wherein each adjustable foot includes a threaded stud element that is accommodated in a corresponding threaded shaft of the respective vertical support column.

13. The stand of claim 10, wherein each of the four vertical support columns includes an inward extrusion formed on a side facing the center of the stand and which runs vertically from the upper most top horizontal plane of each vertical support column descending to a base of the audio-video equipment stand, and in which the vertical support members of the upper and lower sub-frames are coupled to the respective vertical support column.

14. The stand of claim 10 further including a diagonal element connected between each vertical support member and the horizontal support member connected to the vertical support member of the upper and lower sub-frames.

15. The stand of claim 10, further comprising, on the upper and lower shelves, a plurality of fixing plates, each of the plurality of fixing plates disposed in a respective recess in a top surface of the upper and lower shelves over a respective one of the plurality of support devices, wherein the support devices are attached to the fixing plates through the respective upper and lower shelves.

16. The stand of claim 15, wherein the upper and lower shelves are rectangular and identical to each other.

17. The stand of claim 15, wherein each of the support devices comprise an inverted cone portion over a non-inverted cone portion.

18. The stand of claim 17, wherein each of the support devices further includes:

a circular top integrally formed over the inverted cone portion and including three holes which mate with corresponding threaded cylindrical extrusions protruding from a bottom of a respective fixing plate.

19. The stand of claim 10, further comprising a plurality of vertically arranged electrical receptacles in each of the back vertical support columns on a surface of the back vertical support columns facing towards a back of the stand.

20. The stand of claim 19, further comprising an on/off switch on one of the at least two back support columns that controls power to the plurality of vertically arranged electrical receptacles.

21. The stand of claim 19, further comprising a cable manifold connected between the two back vertical support columns at a bottom of the two back vertical support columns, and including a receptacle for receiving electrical power that is electrically connected to the vertically arranged receptacles in the two back vertical support columns.

22. The stand of claim 21, wherein the cable manifold is angled towards the center of the stand from each of the two back vertical support columns.

23. The stand of claim 19, wherein the plurality of vertically arranged electrical receptacles are disposed in a recess in the respective back vertical support columns.

24. The stand of claim 10, wherein each of the support devices of the upper and lower shelves attach to a respective circular fixing plate disposed in a corresponding recess on a top portion of the upper and lower shelves, and which includes a circular top extrusion with three cylindrical extrusions of equal distance emanating from an underside of the circular top extrusion and which provide a threaded hole within each of the three cylindrical extrusions.

25. The stand of claim 10, further comprising:

a set of support brackets each having a vertical support member mounted to a respective one of the vertical support columns, a horizontal support member extending from the vertical support member towards the center of the stand, and a support body at an end of the horizontal support member, wherein each of the set of support brackets are mounted at the same height between the upper and lower sub-frames; and a mid-shelf having a plurality of support devices extending downward from a bottom of the mid shelf and located in correspondence with a respective one of the support bodies of the set of support brackets.

26. An audio visual equipment stand, comprising:

four vertical support columns including two front vertical support columns and two back vertical support columns, wherein each of the four vertical support columns are disposed at a respective corner of the audio visual stand, and wherein each of the four vertical support columns are angled towards a center of the audio visual stand along a horizontal width of each of the respective vertical support columns, the two back vertical support columns each including a vertical recess and a plurality of vertically arranged receptacles;

an upper sub-frame rigidly connected to each of the four vertical support columns at an upper portion of each of the four vertical support columns;

a lower sub-frame rigidly connected to each of the four vertical support columns at a lower portion of each of the four vertical support columns;

the upper and lower sub-frames each having four vertical support members that are each coupled to a respective one of the four vertical support columns, four horizontal support members each extending from a respective one of the vertical support members towards the center of the audio visual stand, four support body segments each of which are formed at an end of a respective one of the horizontal support members and which are connected in succession by four intermediary support members; and an upper shelf supported by the upper sub-frame and a lower shelf supported by the lower sub-frame, each having a plurality of support devices extending downward from a bottom of the upper and lower shelves and located in correspondence with a respective one of the support body segments of the upper sub-frame and lower sub-frame, respectively; and a cable manifold connected between the two back vertical support columns at a bottom of the two back vertical support columns, and including a receptacle for receiving electrical power that is electrically connected to the vertically arranged receptacles in the two back vertical support columns.

27. The audio visual equipment stand of claim 26, further comprising an adjustable foot disposed on a bottom of each of the four vertical support columns.

28. The audio visual equipment stand of claim 26, further comprising:

a set of support brackets each having a vertical support member mounted to a respective one of the vertical support columns, a horizontal support member extending from the vertical support member towards the center of the stand, and a support body at an end of the horizontal support member, wherein each of the set of support brackets are mounted at the same height between the upper and lower sub-frames; and a mid-shelf having a plurality of support devices extending downward from a bottom of the mid shelf and located in correspondence with a respective one of the support bodies of the set of support brackets.

* * * * *